US006264438B1

(12) United States Patent
Fukami

(10) Patent No.: US 6,264,438 B1
(45) Date of Patent: Jul. 24, 2001

(54) RECIPROCATING PUMP HAVING A BALL DRIVE

(75) Inventor: Tadashi Fukami, Inagi (JP)

(73) Assignee: Ohken Seiko Co., Ltd., Inagi (JP)

( * ) Notice: Subject to any disclaimer, the term of this patent is extended or adjusted under 35 U.S.C. 154(b) by 0 days.

(21) Appl. No.: 09/246,698

(22) Filed: Feb. 9, 1999

(30) Foreign Application Priority Data

Feb. 10, 1998 (JP) ..... 10-043018
Nov. 13, 1998 (JP) ..... 10-338402

(51) Int. Cl.[7] ..... F04B 43/00

(52) U.S. Cl. ..... 417/412; 417/413.1; 417/470; 92/71; 74/60

(58) Field of Search ..... 417/470, 412, 417/413.1; 74/18, 60; 92/71

(56) References Cited

U.S. PATENT DOCUMENTS 4,153,391 * 5/1979 Hartley ..... 417/271
4,396,357 * 8/1983 Hartley ..... 417/269

FOREIGN PATENT DOCUMENTS 54-111112 * 8/1979 (JP) ..... 417/412
62-291484 * 12/1987 (JP) ..... 417/412
06147128 5/1994 (JP) .

* cited by examiner

*Primary Examiner*—Cheryl J. Tyler
(74) *Attorney, Agent, or Firm*—Pillsbury Winthrop LLP

(57) ABSTRACT

A pump includes a pump chamber, a reciprocally, driven body that is moved to perform a pumping function by changing the capacity of the pump chamber, and a driving mechanism that reciprocally moves the driven body. The driving mechanism includes a rotating plate which is fixed to an output shaft of a motor and has an annular groove therein. A ball is sandwiched between an annular groove of a driving plate and the annular groove of the rotating plate. When the rotating plate begins rotating, the ball moves in the annular grooves and changes the inclined direction of the driving plate, thus, causing the driven body to reciprocate.

8 Claims, 5 Drawing Sheets

RECIPROCATING PUMP HAVING A BALL DRIVE

BACKGROUND OF THE INVENTION a) Field of the Invention

The present invention relates to a compact pump (reciprocating pump) which uses a diaphragm.

b) Description of the Prior Art

A conventional compact pump of this kind, for example a pump disclosed by Japanese Patent Kokai Publication No. Sho 62-291484, has a configuration shown in FIG. 1.

In this conventional compact pump, a disk like driving plate 35 is mounted on a driving shaft 34 which is studded, at a predetermined inclination angle, to a crank base 33 which is fixed to an output shaft 32 of a motor 31. Single or a plural cup like diaphragm sections 36 which has upward openings are disposed on an outer circumferential portion of the disk like driving plate 35. In case of a pump which comprises a plurality of diaphragm sections 36, the diaphragm sections are arranged at equal intervals along a circumference. A reference numeral 37 represents a cylindrical valve which is integrated, for example, with the diaphragm section 36, a reference numeral 38 designates another valve, a reference numeral 39 denotes an inlet port and a reference numeral 40 represents an exhaust port.

When the output shaft 32 is rotated by driving the motor 31 in the compact pump, the crank base 33 are rotated and the driving shaft 34 is moved like a gooseneck, whereby roots 36*a* of the diaphragm sections are moved up and down. Accordingly, a cup like diaphragm 36 which is located on the left side in FIG. 1 is raised from a position where its root is lowered, whereas a diaphragm 36 which is located on the right side is lowered from a position where its root 36*a* is raised.

As the roots of the diaphragms 36 are moved up and down, the diaphragms suck and exhaust a fluid definite time intervals, thereby causing a pumping function.

In order to cause ideal reciprocal movements of the diaphragms 36 in the conventional compact pump described above, a center A of the driving shaft 35 which is located between the two diaphragm sections 36 must be aligned with a center axis of the output shaft. In other words, the center A must be located on an extension of the output shaft 32. In order to align the center A with the center axis of the output shaft 32, the driving shaft 34 must be equipped with a bearing, thereby prolonging the driving plate 35 and enlarging the pump as a whole.

Furthermore, a rotation of the output shaft 32 causes a reciprocal movement of a driven portion of the diaphragm 36. When a rotating frequency of the motor is enhanced to rotate the output shaft at a higher speed, the pump allows the diaphragm sections 36 to be abnormally deformed, thereby extremely shortening service lives of the diaphragms. Accordingly, the pump requires a large motor which exerts a strong force.

SUMMARY OF THE INVENTION

A primary object of the present invention is to provide a compact pump comprising at least a pump chamber, an inlet port which is communicated with the pump chamber by way of a check valve, an exhaust port which is communicated with the pump chamber by way of another check valve, a driven body which is reciprocally moved in a section of the pump chamber to change a capacity of the pump chamber and a driving mechanism which reciprocally moves the driven body, wherein the driving mechanism comprises a driving plate which has a first annular groove and fixes the driven body, a rotating plate which is fixed to an output shaft of a motor, surrounds the output shaft and has a second annular groove formed at a location corresponding to the first annular groove, and a ball which is placed (sandwiched) between the first groove and the second groove, and wherein the ball revolves between the first annular groove and the second annular groove to change an inclined direction of the driving plate when the motor is driven and the change of the inclined direction causes a reciprocal movement of the driven body to increase or decrease a capacity of the pump chamber, thereby performing a pumping function.

Another object of the present invention is to provide a pump comprising a diaphragm which has at least a cup like diaphragm section, a pump chamber which is formed in the diaphragm section, an inlet port which is communicated with the pump chamber by way of a check valve, an exhaust port which is communicated with the pump chamber by way of another check valve, a driven body which is reciprocally moved in a section of the pump chamber to change a capacity of the pump chamber and a driving mechanism which reciprocally moves the driven body, wherein the driving mechanism comprises a driving plate which is pivoted by a driving plate shaft, has a first annular groove, and fixes the driven body, a rotating plate which is fixed to an output shaft of a motor, surrounds the output shaft and has a second annular groove formed at a location corresponding to the first annular groove, and a ball which is sandwiched between the first annular groove and the second annular groove, wherein an inclined direction of the driving plate is changed by a movement of the ball between the first annular groove and the second annular groove which is caused when the motor is driven and the change of the inclined direction a reciprocal movement of the driven body which causes a reciprocal movement of the driven body to change a capacity of the pump chamber, thereby performing a pumping function, and wherein the driving plate of the driving mechanism is hinged by the driving plate shaft at a location apart from the pump chamber.

Still another object of the present invention is to provide a pump comprising at least a pump chamber, an inlet port which is communicated with the pump chamber by way of a check valve, an exhaust port which is communicated with the pump chamber by way of another check valve, a piston which is reciprocally moved in a section of the pump chamber to change a capacity of the pump chamber and a driving mechanism which reciprocally moves the driven body, wherein the driving mechanism comprises a driving plate which has a first annular groove and fixes the driven body, a rotating plate which is fixed to an output shaft of a motor, surrounds the output shaft and has a second annular groove formed at a location corresponding to the first annular groove, and a ball which is sandwiched between the first annular groove and the second annular groove, and wherein an inclined direction of the driving plate is changed by a ball which revolves between the first annular groove and the second annular groove when a motor is driven and the change of the inclined direction causes a reciprocal movement of the piston to change a capacity of the pump chamber, thereby performing a pumping function.

DETAILED DESCRIPTION OF THE PREFERRED EMBODIMENTS

Now, the preferred embodiments of the reciprocating pump according to the present invention will be described with reference to the accompanying drawings.

Figure 2:
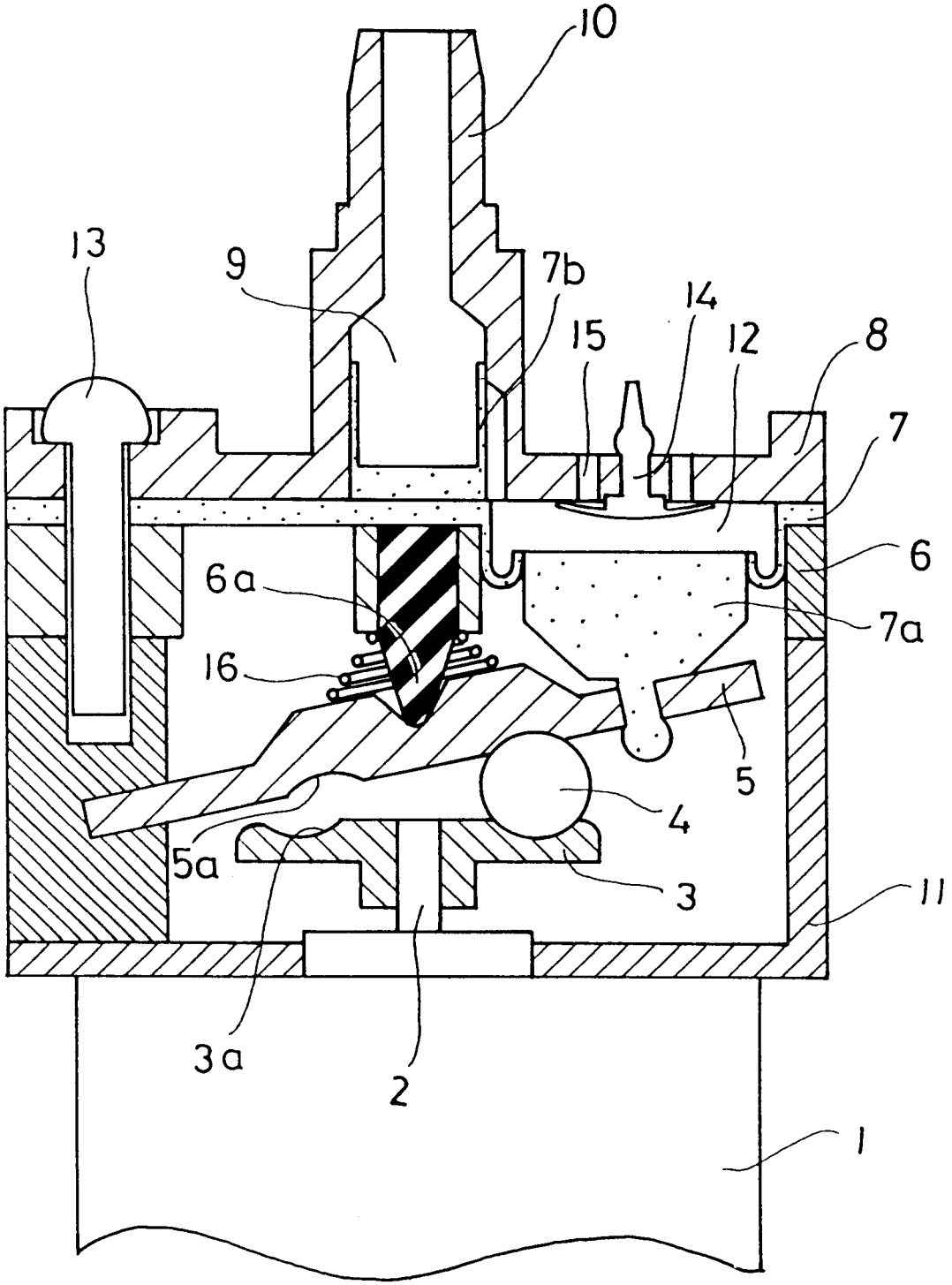
FIG. 2 shows a sectional view illustrating a configuration of a first embodiment of the reciprocating pump according to the present invention.

FIG. 2 shows a first embodiment of the reciprocating pump according to the present invention which is a compact pump using a diaphragm.

In FIG. 2, a reference numeral 1 represents a motor, a reference numeral 2 designates an output shaft of the motor 1, a reference numeral 3 denotes a disk like rotating plate in which a groove 3*a* having an arc-like sectional shape is formed along a circumference around the output shaft 2 so that a ball 4 can roll therein. A reference numeral 5 represents a driving plate which is substantially a disk, for example, and has, like the rotating plate 3, a groove 5*a* having an arc-like sectional shape and formed along a circumference around a center of the driving plate 5 so that the ball 4 can roll therein. A reference numeral 7 designates a diaphragm which has a driven body 7*a* fixed to the driving plate 5, and a reference numeral 8 denotes a valve housing which forms a pump chamber 12 by sandwiching the diaphragm 7 between the valve housing 8 and a cylinder section 6, and fixing the diaphragm 7 to the cylinder section 6 with a screw 13 so as to seal the pump chamber 12. Though only one pump chamber 12 formed in the diaphragm section of the diaphragm 7 is shown in FIG. 2, it is possible to form two or more diaphragms 7 (pump chambers 12), thereby composing a pump which has multiple cylinders.

A valve chamber 9 and an exhaust port 10 which is communicated with the valve chamber 9 are formed integrally with the valve housing 8, and a valve 7*b* which is formed integrally with the diaphragm 7 is disposed in the valve chamber 9. A reference numeral 14 represents a check valve and a reference numeral 15 designates an inlet port.

In the pump described above, the rotating plate 3 and the driving plate 5 are pushed up and set so that the driving plate 5 is inclined in a condition where a center of a top surface of the driving plate 5 is in contact with a stopper pin disposed at a center of the cylinder 6. A stroke of the reciprocal movement of the driven body 7*a* which is formed integrally with the diaphragm 7 is determined by an inclination angle and so on. Furthermore, a reference numeral 16 represents a bias spring which imposes a load on the ball to obtain an adequate frictional force when the ball is loaded too little. It is therefore unnecessary to use the bias spring 16 when an adequate frictional force is exerted to the ball 4 in relationship with a load imposed thereon.

Now, description will be made of functions of the first embodiment explained above.

When the output shaft 2 is rotated by driving the motor 1, the rotating plate 3 which is fixed to the output shaft 2 is rotated. While the rotating plate 3 is rotating, the ball 4 which is pressed to the driving plate 5 by the bias spring 16, etc. moves or revolves around the output shaft 2 while rotating and rolling in a direction which is the same as a rotating direction of the rotating plate 3. Since radii of the groove 3*a* of the rotating plate 3 and the groove 5*a* of the driving plate 5*a* which have the arc-like sectional shapes are substantially equal to each other (the radius of the groove 5*a* of the driving plate 5 is generally slightly smaller), the ball 4 advances at a speed approximately half as fast as a speed of the rotating plate 3, whereby the ball 4 makes approximately one revolution around the output shaft 2 when the rotating plate 3 makes two rotations.

When the rotating plate 3 makes one rotation from the position shown in the drawing, the ball 4 makes half a revolution, or the ball 4 moves from the right side of the output shaft 2 to the left side of the output shaft 2, whereby the driving plate moves the driven body 7*a* of the diaphragm 7 from an upper position to a lower position. As the rotating plate 3 rotates, the driven body 7*a* moves up and down as described above, thereby performing a pumping function. Speaking more concretely, a capacity of the pump chamber 12 is increased when the driven body 7*a* is lowered from the position shown in the drawing, whereby a gas flows into the pump chamber through the inlet port while opening the valve 14. When the driving body 7*a* is raised once again, the capacity of the pump chamber is decreased, whereby the gas in the pump chamber is pressurized and exhausted from the exhaust port 10 through the valve chamber 9 while opening the valve 7*b*.

The pump aspirates the gas through the inlet port 15 and exhausts it through the exhaust port 10 by repeating the movements described above, thereby performing the pumping function.

Since the reciprocating pump according to the present invention described above has the configuration wherein the ball 4 is sandwiched between the rotating plate 3 and the driving plate 5 both of which have the disk like shapes, the pump uses a driving mechanism which is lower than that of the conventional pump and can be configured more compact than the conventional pump.

Furthermore, since the ball functions to move up and down the driven body 7*a* of the diaphragm 7 each time the rotating plate 3 makes half a rotation as the output shaft 2 rotates, the pump according to the present invention provides a result which is equivalent to that obtained by reducing a rotation by way of a reduction gear in the conventional reciprocating pump, thereby being capable of operating at an enhanced rotating frequency of the motor 2 even when the pump is configured compact without reserving a space for disposing gears.

Though the diaphragm is integrated with the driven body in the reciprocating pump according to the present invention described above, the driven body may be separated from the diaphragm. In other words, it is possible to fix one side of a piston (driven body) to the driving plate 5 and fix the other side of the piston in a condition where a diaphragm is sandwiched between this side of the piston and a retainer.

Like the pump shown in FIG. 2, a reciprocating pump which uses a piston such as that described above performs a pumping function by rotating an output shaft by driving a motor, rotating a rotating plate with the rotation of the output shaft and causing a reciprocal movement of a portion of a driving plate to which the piston is fixed (a driven portion of the piston) by a revolution of a ball.

Figure 1:
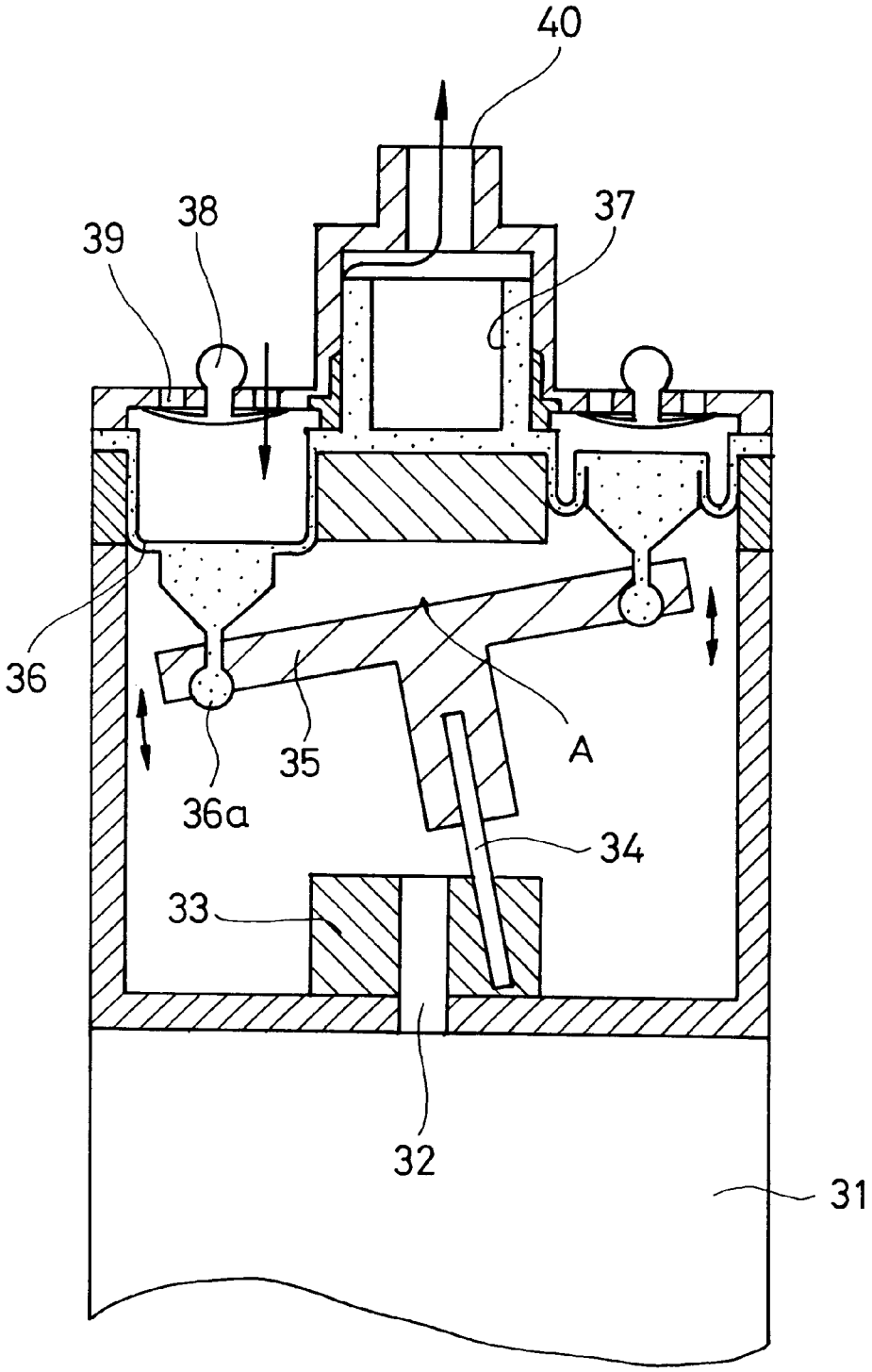
FIG. 1 PRIOR ART
FIG. 1 shows a sectional view illustrating a configuration of a conventional reciprocating pump.

The reciprocating pump according to the present invention which uses the piston described above can also be configured as a reciprocating pump which has a plurality of cylinders like the pump shown in FIG. 1 by disposing a plurality of cylinders and piston along a circumference.

The pump preferred as the first embodiment is a diaphragm pump in which the pump chamber 12 is formed in a diaphragm section of the diaphragm 7, the exhaust port is communicated with the pump chamber 12 by way of the check valve 7*b* and the inlet port 15 is communicated with the pump chamber 12 by way of the check valve 14.

In the first embodiment, a driving mechanism is composed of the motor 1, the rotating shaft 2, the ball 4, the driving plate 5, the driving body 7*b* and so on.

Figure 3:
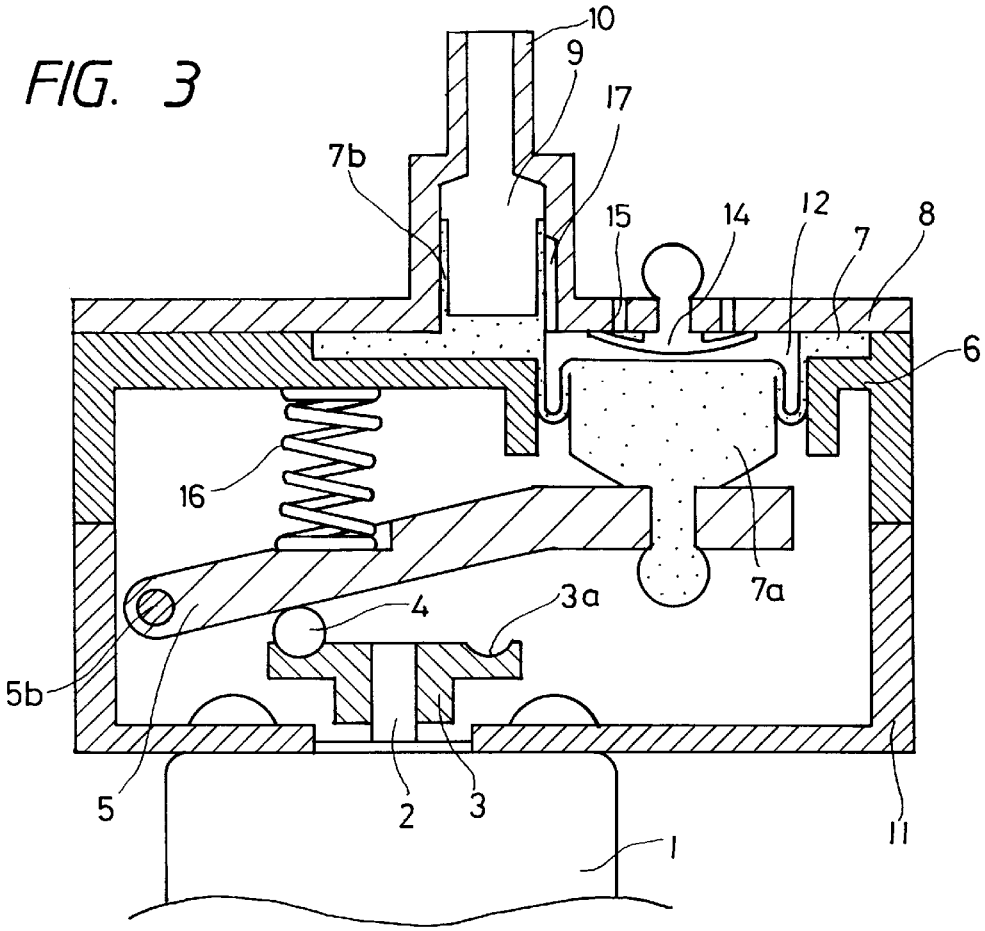
FIGS. 3 and 4 show sectional views illustrating a configuration of a second embodiment of the reciprocating pump according to the present invention.

FIG. 3 is a sectional view illustrating a second embodiment of the diaphragm pump according to the present invention. In FIG. 3, a reference numeral 1 represents a motor, a reference numeral 2 designates an output shaft of the motor 1, a reference numeral 3 denotes a rotating plate which is fixed to the output shaft 2, and has a semicircular sectional shape and a groove 3*a* formed concentrically with the output shaft 2 (a circular groove as seen from over or under FIG. 3), a reference numeral 4 represents a ball which is placed in the groove 3*a* of the rotating plate 3, a reference numeral 5 designates a driving plate which is pivoted at an end by a driving plate shaft 5*b*, a reference numeral 6 denote a cylinder section and a reference numeral 7 represents a diaphragm which has a driven section 7*a* fixed on a side opposite to the driving plate shaft 5*b* of the driving plate 5. The diaphragm is disposed in the cylinder section 6 and fixed between the cylinder section 6 and a valve housing 8, and a cylinder is fixed to a mounting base 11 with a screw or the like. Accordingly, a pump chamber 12 is formed in the diaphragm 7. Furthermore, a reference numeral 14 represents an intake valve, a reference numeral 7*b* designates an exhaust valve, a reference numeral 10 denotes an exhaust port, a reference numeral 15 represents an inlet port, a reference numeral 16 designates a spring and a reference numeral 17 denotes a vent groove.

When the output shaft 2 is rotated by driving the motor 1 in the pump preferred as the second embodiment, the rotating plate 3 rotates, whereby the ball 4 rolls and moves along the groove 3*a* of the rotating plate 3 while rotating. When the rotating plate 3 makes one rotation, the ball 4 revolves 180° around the output shaft 2, thereby changing a condition shown in FIG. 3 into another condition shown in FIG. 4. Accordingly, the driving plate 5 turns in a direction indicated by an arrow around the driving plate shaft 5*b* functioning as a fulcrum. When the driving plate 5 turns as described above, a portion to which the driven section 7*a* of the diaphragm 7 is fixed moves downward, thereby pulling down the driven section 7*a* of the diaphragm 7, enlarging a capacity of the pump chamber 12 and sucking external air through the inlet port 15. When the output shaft 2 makes another rotation, the ball 4 further revolves 180° around the output shaft 2, thereby returning the condition shown in FIG. 4 to the condition shown in FIG. 3. At this time, the driven section 7*a* of the diaphragm 7 is raised to decrease the capacity of the pump chamber 12, thereby exhausting the air from the exhaust port 10 through the vent groove 17 and the exhaust valve 7*b*.

The pump preferred as the second embodiment allows the ball 4 to revolve 180° each time the rotating plate 3 makes one rotation when the output shaft 2 is rotated by driving the motor 1 as described above and utilizes the revolution of the ball 4 to move up and down the end of the driving plate 5 around the driving plate shaft 5*b* as the fulcrum. That is, the pump performs a pumping function by reciprocally moving the driven section 7*a* of the diaphragm 7 with the driving plate 5 each time the output shaft 2 makes two rotations.

Figure 5:
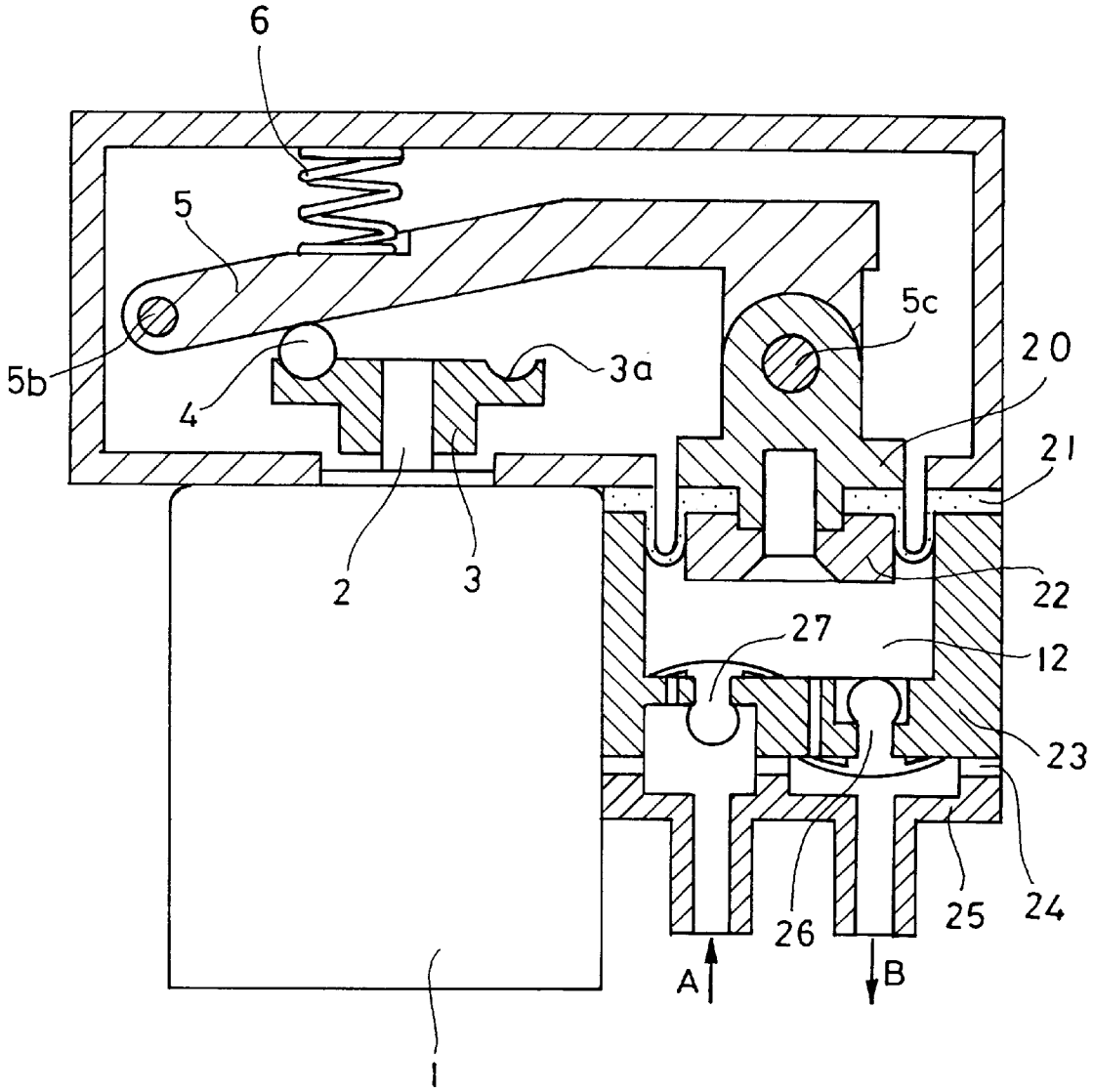
FIG. 5 shows a sectional view illustrating a configuration of a third embodiment of the reciprocating pump according to the present invention.

FIG. 5 is a sectional view illustrating a third embodiment of the present invention. The third embodiment is characterized in that a diaphragm 21 is disposed so as to face downward, and a pump chamber 12 is disposed below a driving mechanism, i.e., a rotating plate 3, a ball 4, a driving plate 5, a driving plate shaft 5*b*, etc., so that the pump is to be used as a suction pump.

In FIG. 5, a reference numeral 1 represents a motor, a reference numeral 2 designates an output shaft of the motor 1, a reference numeral 3 denotes a rotating shaft, a reference numeral 4 represents a ball, a reference numeral 5 designates a driving plate, a reference numeral 5*b* denotes a driving plate shaft and a reference numeral 6 represents a spring. Though these members are disposed at locations different from those in the second embodiment, functions or movements of these members remain substantially unchanged from those in the second embodiment.

Furthermore, a reference numeral 20 represents a piston, a reference numeral 21 designates a diaphragm and a reference numeral 22 denotes a retainer which fixes the diaphragm 21 to a horizontal shaft 5*c* of the driving plate 5 by sandwiching the diaphragm 21 between the retainer 22 and the horizontal shaft 5*c*, thereby composing the piston 20. The piston 20 and a housing 23 compose a pump chamber 12.

Furthermore, a reference numeral 24 represents a gasket, a reference numeral 25 designates an inlet/exhaust port, a reference numeral 26 denotes an exhaust valve and a reference numeral 27 represents a suction valve; these members being fixed to the housing 23.

When the output shaft 2 is rotated by driving the motor 1, the third embodiment allows the ball 4 to revolve as in the pump preferred as the second embodiment, whereby the driving plate 5 turns around the driving plate shaft 5*b* functioning as a fulcrum, thereby moving up and down its end opposite to the driving plate shaft 5*b*. That is, the driving plate 5 performs a reciprocal movement each time the output shaft 2 makes two rotations. By this reciprocal movement, a fluid is sucked in a direction indicated by an arrow A in a condition shown in FIG. 5. When the ball 4 moves from a left side to a right side in FIG. 5, the fluid is exhausted and flowed in a direction indicated by an arrow B. A pumping function is performed by repeating the reciprocal movement.

Different from the first embodiment, the second embodiment of the present invention described above is configured to turn the driving plate 5 around the driving plate shaft functioning as a fulcrum.

Furthermore, the third embodiment of the present invention is different in that it uses the piston as the driven body. Though the piston 20 is retained by the diaphragm 21 in the third embodiment, it is possible to dispose a sealing member 30 shown in FIGS. 6 and 7 which is made of an elastic material and has a V-shaped section in a piston 20 as shown in FIG. 6 so that the piston is reciprocally moved to perform a pumping function while maintaining an airtight condition by keeping the sealing member 30 in contact with an inside wall of the housing which composes the pump chamber.

Figure 4:
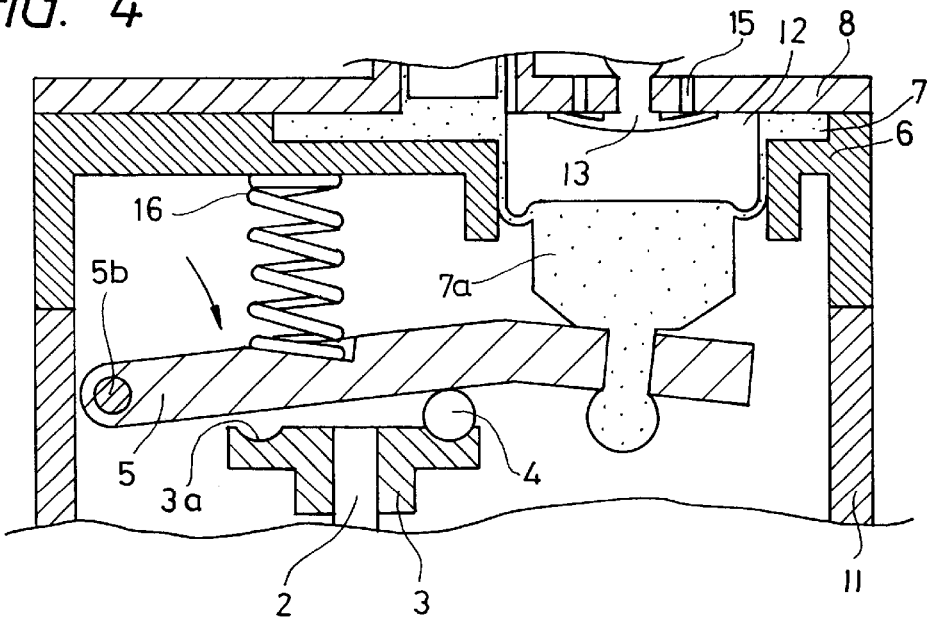
Figure 6:
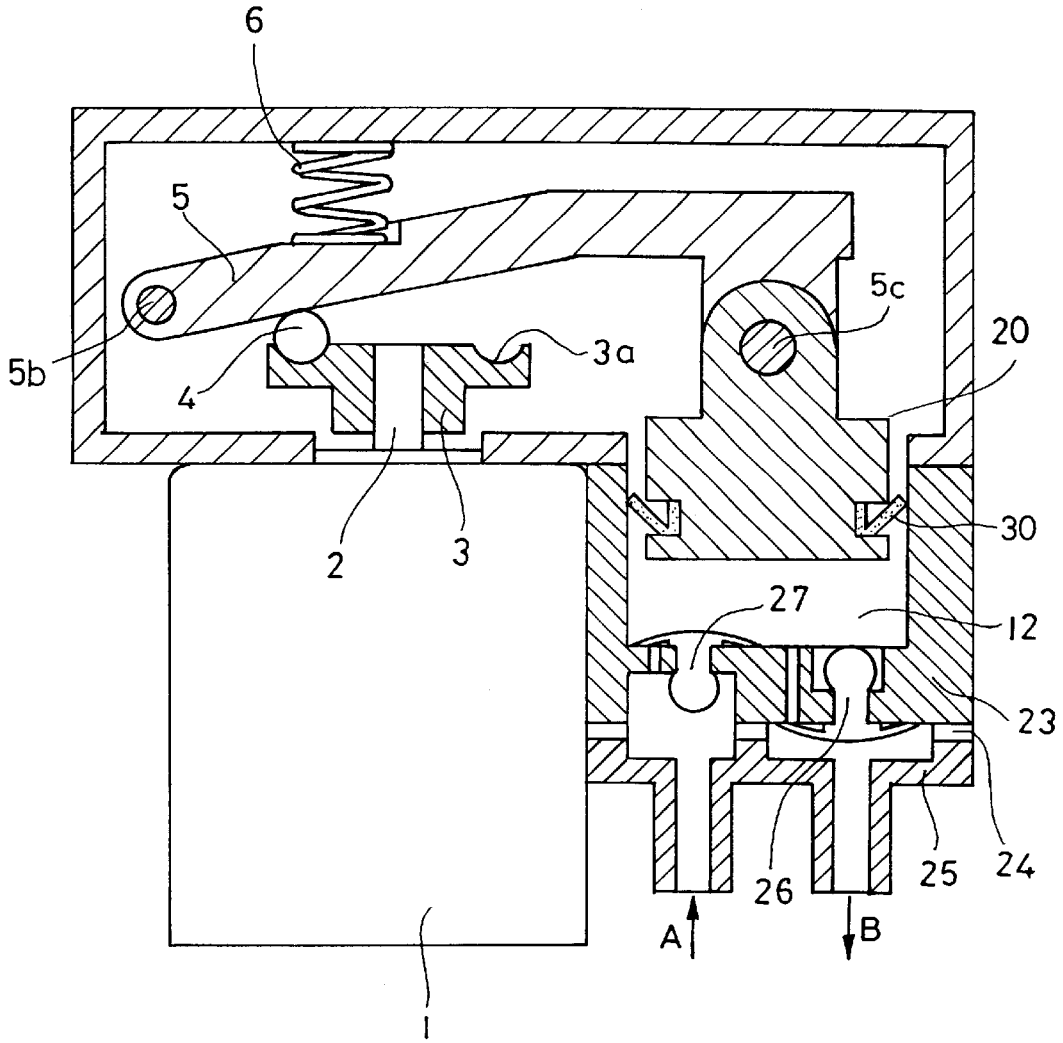
FIG. 6 shows a sectional view illustrating a configuration of a fourth embodiment of the reciprocating pump according to the present invention.
Figure 7:
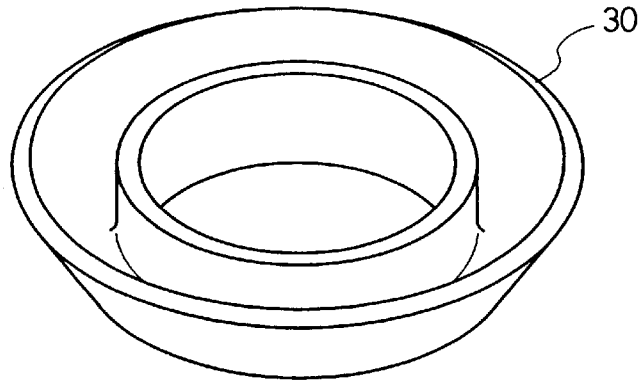
FIG. 7 shows a perspective view illustrating a sealing member to be used in the reciprocating pump shown in FIG. 5.

The pump shown in FIG. 2, FIG. 3 or FIG. 4 can also use the piston shown in FIG. 5 or FIG. 6 as a driven body which performs a pumping function.

The compact pump (reciprocating pump) according to the present invention which has the configuration wherein only the ball 4 is sandwiched between the rotating plate 3 and the driving plate 5 both of which are disk like members uses a driving section which is lower than that of the conventional pump and can be configured more compact.

Furthermore, since the pump according to the present invention moves up and down the piston owing to the function of the ball each time the rotating plate 3 makes half a rotation as the output shaft 2 rotates, the pump provides a result which is equivalent to that obtained by reducing a rotation to ½ by way of a reduction gear in the conventional reciprocating pump, thereby being capable of operating at an enhanced rotating frequency of the motor 1 even when the pump is configured compact without reserving a space for disposing gears.

Since the reciprocating pump according to the present invention does not use a driving shaft which is inclined as shown in FIG. 1, the pump makes it easy to design and assemble a driving mechanism in particular, and allows the driving mechanism to be remarkably lowered, whereby the pump itself can be configured compact. Furthermore, the pump according to the present invention is capable of reducing a rotation without using a reduction gear.

What is claimed is:

1. A pump comprising:

at least a pump chamber;

an inlet port which is communicated with said pump chamber by way of a check valve;

an exhaust port which is communicated with said pump chamber by way of another check valve;

a driven body which is reciprocally moved in a section of said pump chamber to change a capacity of said pump chamber; and a driving mechanism which reciprocally moves said driven body, wherein said driving mechanism comprises a driving plate which has a first annular groove and fixes said driven body, a rotating plate which is fixed to an output shaft of a motor, surrounds said output shaft and has a second annular groove, a ball which is located between said first annular groove and said second annular groove and a spring which is disposed to maintain said driven body in an inclined condition by pressing said driven body to said ball, and wherein said pump is configured to perform a pumping function by allowing said ball to move between said first annular groove and said second annular groove while rotating and revolving when said rotating plate is rotated by said motor, thereby changing an inclined direction of said driving plate, reciprocally moving said driven body, and increasing and decreasing a capacity of said pump chamber.

2. A pump according to claim 1, wherein said driving plate is pivoted by a driving plate shaft at a location apart from said pump chamber and wherein said driving plate rotates around said driving plate shaft functioning as a fulcrum.

3. A pump according to claim 2, wherein said pump chamber is disposed so as to be adjacent to said motor.

4. A pump according to claim 1, 2 or 3, wherein said pump chamber is formed in a diaphragm section which is formed in a cup like form in a diaphragm and wherein said driving mechanism transforms the cup like diaphragm section of said diaphragm to change a capacity of said pump chamber, thereby causing a pumping function.

5. A pump according to claim 1, 2 or 3, wherein said driving mechanism is a piston which is reciprocally moved to change the capacity of the pump chamber.

6. A pump according to claim 5, wherein said piston is retained in a condition where it is sealed by a diaphragm.

7. A pump according to claim 5, wherein an annular sealing member which has a V-shaped sectional shape is disposed in said piston and wherein said sealing member is moved while being kept in close contact with an inside wall of said pump chamber when said piston is reciprocally moved.

8. The pump according to claim 1, including a plurality of pump chambers disposed along a circumference of a circle which has a center at a point on said output shaft or an extension line of the output shaft.

* * * * *